US010900303B2

(12) United States Patent
Akbari et al.

(10) Patent No.: US 10,900,303 B2
(45) Date of Patent: Jan. 26, 2021

(54) MAGNETIC GRADIENT DRILLING

(71) Applicant: BOARD OF SUPERVISORS OF LOUISIANA STATE UNIVERSITY AND AGRICULTURAL AND MECHANICAL COLLEGE on behalf of LSU OITC, Baton Rouge, LA (US)

(72) Inventors: Babak Akbari, Baton Rouge, LA (US); Garrett L. Nielsen, Bellaire, TX (US)

(73) Assignee: BOARD OF SUPERVISORS OF LOUISIANA STATE UNIVERSITY AND AGRICULTURAL AND MECHANICAL COLLEGE, Baton Rouge, LA (US)

( * ) Notice: Subject to any disclaimer, the term of this patent is extended or adjusted under 35 U.S.C. 154(b) by 58 days.

(21) Appl. No.: 16/089,650

(22) PCT Filed: Mar. 31, 2017

(86) PCT No.: PCT/US2017/025435
§ 371 (c)(1),
(2) Date: Sep. 28, 2018

(87) PCT Pub. No.: WO2017/173305
PCT Pub. Date: Oct. 5, 2017

(65) Prior Publication Data

US 2019/0120001 A1 Apr. 25, 2019

Related U.S. Application Data

(60) Provisional application No. 62/316,016, filed on Mar. 31, 2016.

(51) Int. Cl.

| | |
|---|---|
| ***E21B 21/08*** | (2006.01) |
| ***E21B 33/06*** | (2006.01) |
| ***H01F 1/44*** | (2006.01) |

(52) U.S. Cl.
CPC ..... *E21B 21/08* (2013.01); *E21B 33/06* (2013.01); *H01F 1/447* (2013.01)

(58) Field of Classification Search
CPC ..... E21B 21/08; E21B 33/06; H01F 1/447
See application file for complete search history.

(56) References Cited

U.S. PATENT DOCUMENTS

| | | | | |
|---|---|---|---|---|
| 7,980,329 | B2 | 7/2011 | Spiecker et al. | |
| 8,443,875 | B2 * | 5/2013 | Lee | E21B 10/322 166/66.5 |

(Continued)

FOREIGN PATENT DOCUMENTS

| | | |
|---|---|---|
| CA | 2570263 | 1/2006 |
| EP | 2929122 | 10/2015 |

(Continued)

OTHER PUBLICATIONS

International Search Report and Written Opinion in International Application No. PCT/US2017/025435 dated Jun. 21, 2017, 16 pages.

*Primary Examiner* — Daniel P Stephenson
(74) *Attorney, Agent, or Firm* — Thomas|Horstemeyer, LLP

(57) ABSTRACT

Aspects of magnetic gradient drilling are described. In one embodiment, a system includes a drill pipe, drilling fluid, and a magnetic assembly tool connected to or integrated with the drill pipe. Among other elements, the magnetic assembly tool can include a magnetic field generator configured to generate a magnetic field and create an additional pressure drop in the drilling fluid outside the drill pipe, and a magnetic shielding material configured to shield the magnetic field from inside the drill pipe.

20 Claims, 8 Drawing Sheets

(56) References Cited

U.S. PATENT DOCUMENTS

| | | | | |
|---|---|---|---|---|
| 8,808,567 | B2 | 8/2014 | Mazyar et al. | |
| 9,791,589 | B2 * | 10/2017 | Chen | G01V 3/38 |
| 9,952,006 | B2 * | 4/2018 | Barron | F28F 13/00 |
| 10,060,842 | B2 * | 8/2018 | McMillon | G01N 11/04 |
| 10,435,968 | B2 * | 10/2019 | Richards | E21B 43/128 |
| 2003/0052672 | A1 * | 3/2003 | Speier | G01N 24/081 324/303 |
| 2005/0028522 | A1 * | 2/2005 | Fripp | E21B 47/187 60/533 |
| 2006/0231549 | A1 * | 10/2006 | Kisner | H05B 6/101 219/635 |
| 2009/0118126 | A1 * | 5/2009 | Burke | H01L 39/2461 505/211 |
| 2011/0297394 | A1 | 12/2011 | Vandelden | |
| 2014/0110116 | A1 | 4/2014 | Ludtka et al. | |
| 2014/0262268 | A1 * | 9/2014 | Kageler | C09K 8/516 166/292 |
| 2015/0027781 | A1 * | 1/2015 | Vestavik | E21B 21/08 175/57 |
| 2015/0041155 | A1 | 2/2015 | Barnes-Kahoe | |
| 2019/0120001 | A1 * | 4/2019 | Akbari | E21B 33/06 |

FOREIGN PATENT DOCUMENTS

| | | |
|---|---|---|
| WO | 2006007347 | 1/2006 |
| WO | 2013001512 | 5/2013 |
| WO | 2015099714 A1 | 7/2015 |

* cited by examiner

MAGNETIC GRADIENT DRILLING

CROSS-REFERENCE TO RELATED APPLICATIONS

This application is the 35 U.S.C. § 371 national stage application of PCT Application No. PCT/US2017/025435, filed Mar. 31, 2017, where the PCT claims the benefit of U.S. Provisional Patent Application No. 62/316,016, filed Mar. 21, 2016, the complete disclosures of which are hereby fully incorporated herein by reference in their entireties.

BACKGROUND

A drill string is a column of drill pipe, drill collars, and other components that transfer drilling fluid and torque to a drill bit. Generally, the drill string is hollow, and drilling fluid is pumped down through the drill string and circulated back up a void between the drill string and the wellbore and/or casing. Using the drill string, drilling fluid can be pumped down through the drill string using mud pumps, and torque can be provided to the drill bit using a kelly or top drive, for example, among other types of known drive mechanisms.

A drill string is typically made up of three or more sections, including a bottom hole assembly, a transition pipe, and a length of drill pipe. The bottom hole assembly includes a drill bit, one or more drill collars, and one or more stabilizers, among other components. In some cases, the bottom hole assembly can also include a downhole motor, rotary steerable system, measurement tools, and/or logging tools. In some cases, heavyweight drill pipe can be used as a transitional section between the drill collars of the bottom hole assembly and the drill pipe. The heavyweight drill pipe is used to provide a relatively flexible transition between the drill collars and the drill pipe and, to some extent, add weight to the drill bit. Drill pipe often makes up a significant portion of the drill string leading back up to the surface. Each drill pipe section is a long tubular section with a specified outside diameter. Larger diameter tool joints are located at the end of each drill pipe. Typically, one end of the drill pipe has a male or pin connection while the other end has a female or box connection.

SUMMARY

Various embodiments for magnetic gradient drilling operations are described herein, including but not limited to a system including a drill pipe or a casing and a magnetic assembly tool. The magnetic assembly tool can be connected to or integrated with the drill pipe or the casing. The magnetic assembly tool can include a magnetic field generator configured to generate a magnetic field. The magnetic assembly tool also includes a magnetic shielding material to shield at least part of the magnetic field. Based on the shielding, the magnetic field can be directed to a region outside the drill pipe or the casing. When the magnetic field interacts with a magnetorheological fluid outside the drill pipe or casing, the magnetorheological fluid creates flow restriction outside the drill pipe or the casing.

In one aspect of the embodiments, the magnetorheological fluid can be a magnetorheological drill fluid or a magnetorheological cement. The magnetorheological fluid can be pumped and flows inside the drill pipe or the casing and flows outside the drill pipe in an annular region between the drill pipe or the casing in the wellbore.

The magnetic field generator can include at least one of a magnetostrictive material, a permanent magnet, or an electromagnet, among other components capable of creating a magnetic field. In some cases, the magnetic field generator can be configured to selectively generate the magnetic field based on an electric current or axial force applied to the drill pipe or the casing.

The magnetic assembly tool can also include a sealing mechanism configured to direct axial force applied to the drill pipe or the casing into the magnetostrictive material. The direction of the axial force can be relied upon to generate or modify the magnetic field generated by the magnetostrictive material.

Based on the magnetic field generated by the magnetic assembly tool, the magnetorheological fluid coagulates outside the drill pipe or the casing to create a choke point in the annulus outside the drill pipe or the casing. At the same time, the magnetic shielding material shields the magnetic field from the downstream flow of the magnetorheological fluid inside the drill pipe or the casing.

BRIEF DESCRIPTION OF THE DRAWINGS

For a more complete understanding of the embodiments described herein and the advantages thereof, reference is now made to the following description, in conjunction with the accompanying figures briefly described as follows.

Figure 1:
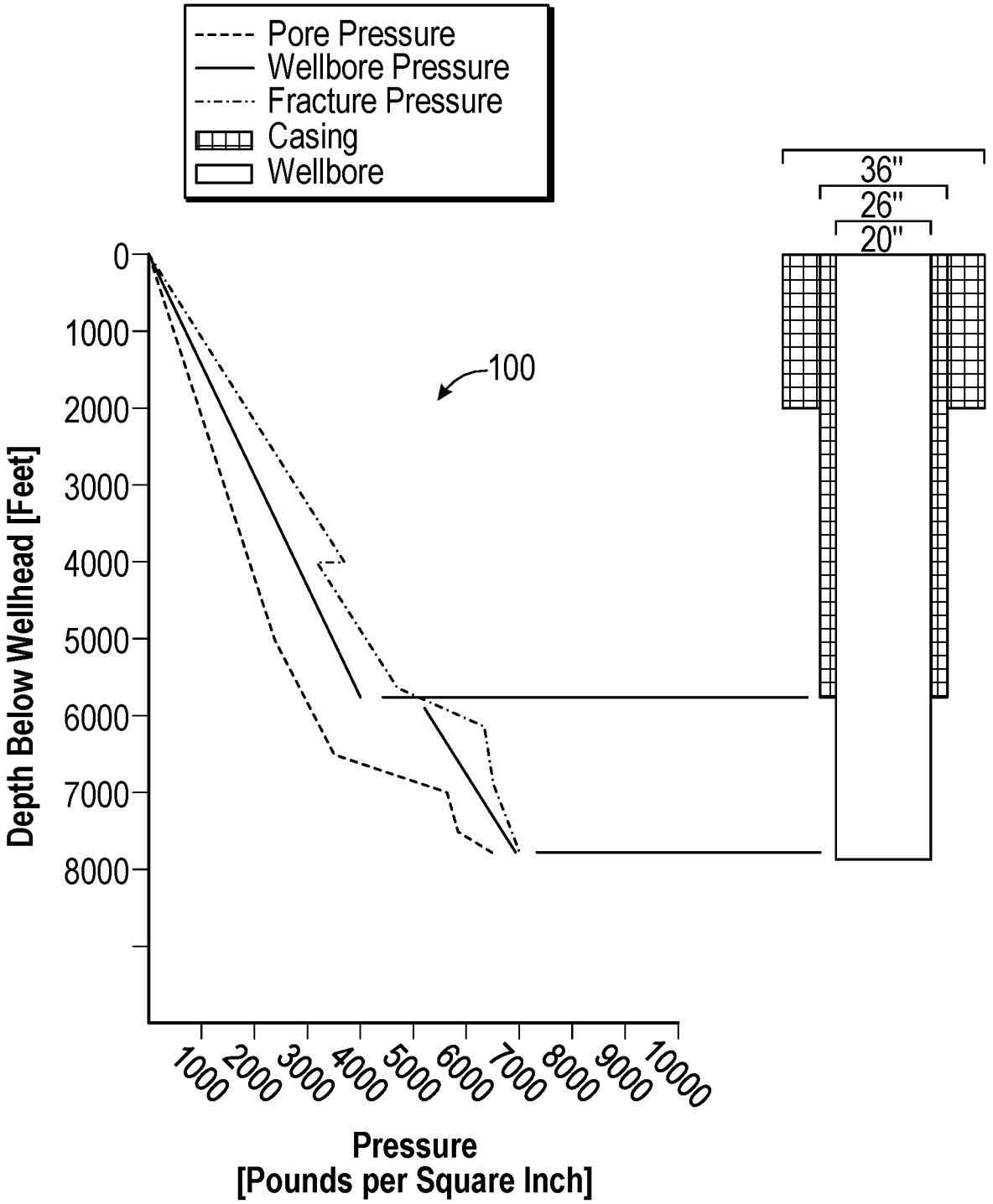
FIG. 1 illustrates an example pressure window to reach a certain drilling depth according to various example embodiments described herein.

The drawings illustrate only example embodiments and are therefore not to be considered limiting of the scope described herein, as other equally effective embodiments are within the scope and spirit of this disclosure. The elements and features shown in the drawings are not necessarily drawn to scale, emphasis instead being placed upon clearly illustrating the principles of the embodiments. Additionally, certain dimensions may be exaggerated to help visually convey certain principles. In the drawings, similar reference numerals between figures designate like or corresponding, but not necessarily the same, elements.

DETAILED DESCRIPTION

As noted above, a drill string is typically made up of three or more sections, including a bottom hole assembly, a transition pipe, and a length of drill pipe. Generally, the drill string is hollow, and drilling fluid is pumped down through the drill string and circulated back up a void (i.e., the annulus) between the drill string and the wellbore and/or casing. Drilling fluid can be pumped down through the drill string using pumps, and torque can be provided to the drill bit using a kelly or top drive, for example, among other types of known drive mechanisms.

The embodiments described herein achieve selective pressure drop points along the annulus fluid path for drilling, cementing, production, completion, etc. operations. In other words, the embodiments allow for selective drilling mud rheology alteration points along the fluid path through the annulus during drilling operations. The embodiments also allow for selective cement rheology alteration points along the fluid path through the annulus for cementing operations. Several advantages can be achieved through the concepts described herein based on selective annulus pressure modifications. The system achieves selective manipulation of the annulus pressure profile to follow or track pressure requirements for various subterranean formations. In that way, the system can help to reduce the need to set as many intermediate casing strings between drilling operations. The system can also help to prevent the loss of integrity of formations during cementing operations.

One aspect of the embodiments includes an in-situ, downhole magnetic field generator working with a magnetorheological fluid. The magnetorheological fluid can include a magnetorheological drilling fluid, a magnetorheological cement, or other magnetorheological fluid. In that context, a magnetorheological drilling fluid is a drilling fluid including particles that align themselves in the presence of a magnetic field. In the presence of a magnetic field, the magnetorheological drilling fluid undergoes an increase in viscosity and/or fluid yield point. As compared to conventional drilling fluid, which may include barite as a weighting agent, for example, the weighting agent can be replaced (in part or whole) by micro-sized iron particles or other suitable particles in the magnetorheological drilling fluid. The alignment of the particles in the magnetorheological drilling fluid leads to an increase in the apparent viscosity of the fluid, which then requires more force to flow and creates an additional drop in pressure. Similarly, a magnetorheological cement is a cement including micro-sized iron or other suitable particles that align themselves in the presence of a magnetic field. The alignment of the particles in the magnetorheological cement leads to an increase in the apparent viscosity of the cement, which then requires more force to flow and creates an additional drop in pressure.

According to various embodiments described herein, any number of magnetic field generator downhole tools can be used as components in a drill string or casing. For example, one or more magnetic field generator downhole tools can be placed at any suitable location(s) along, between, or as tool joints in the column of drill pipes, in the bottom hole assembly, or at any other suitable location in a drill string. Similarly, one or more magnetic field generator downhole tools can be placed at any suitable location along, between, or as tool joints in the column of casing pipes or at any other suitable location in a casing string.

When used in a drill string, the downhole magnetic field generator includes a pathway for magnetorheological drilling fluid to flow down the drill string, a shielding layer to protect the drilling fluid flowing down the drill string from a magnetic field generated by a magnetic field generator, and a material or mechanism to control the strength of the magnetic field as it interacts with the magnetorheological drilling fluid as it flows back up the annulus.

One example downhole magnetic field generator is embodied as a magnetic assembly tool consisting of one or more magnets, one or more electromagnets, or a combination of one or more magnets and electromagnets. The magnetic field generator can also include a magnetic shielding element used to prevent the magnetic field generated by the one or more magnets from influencing the magnetorheological drilling fluid within an inner cavity of the drill pipe in the drill string. The magnetic field generator can also include a protective material and/or a sleeve or ratchet activated by a signature axial and/or tangential stress to shield the magnetic field and reduce its effect on fluid in the annulus. The magnetic field generator can also include a magnetostrictive material. Magnetic flux can be generated by the magnetostrictive material in response to changes in stress or strain being applied to it.

The downhole magnetic field generators described herein are not limited to use in drill strings for drilling operations, but can also be attached or integrated with casings of any size for cementing operations. In that case, a downhole magnetic field generator includes a pathway for magnetorheological cement to flow down the drill well casing, a shielding layer to protect the cement flowing down the drill well casing from a magnetic field generated by a magnetic field generator, and a material or mechanism to control the strength of the magnetic field as it interacts with the cement as it flows back up the annulus.

Turning to the drawings, FIG. 1 illustrates an example pressure window 100 to reach a certain drilling depth. The pressure gradient experienced at any depth is practically constant in conventional drilling systems. Thus, pressure generally increases with depth, and upper formations are typically isolated (e.g., with casings) as drill depths increase because the increased equivalent mud density at the deeper drill depths may exceed the integrity of the upper formations. In the example shown in FIG. 1, two casing strings are used to isolate upper (i.e., shallower) formations from higher mud density requirements.

Figure 2:
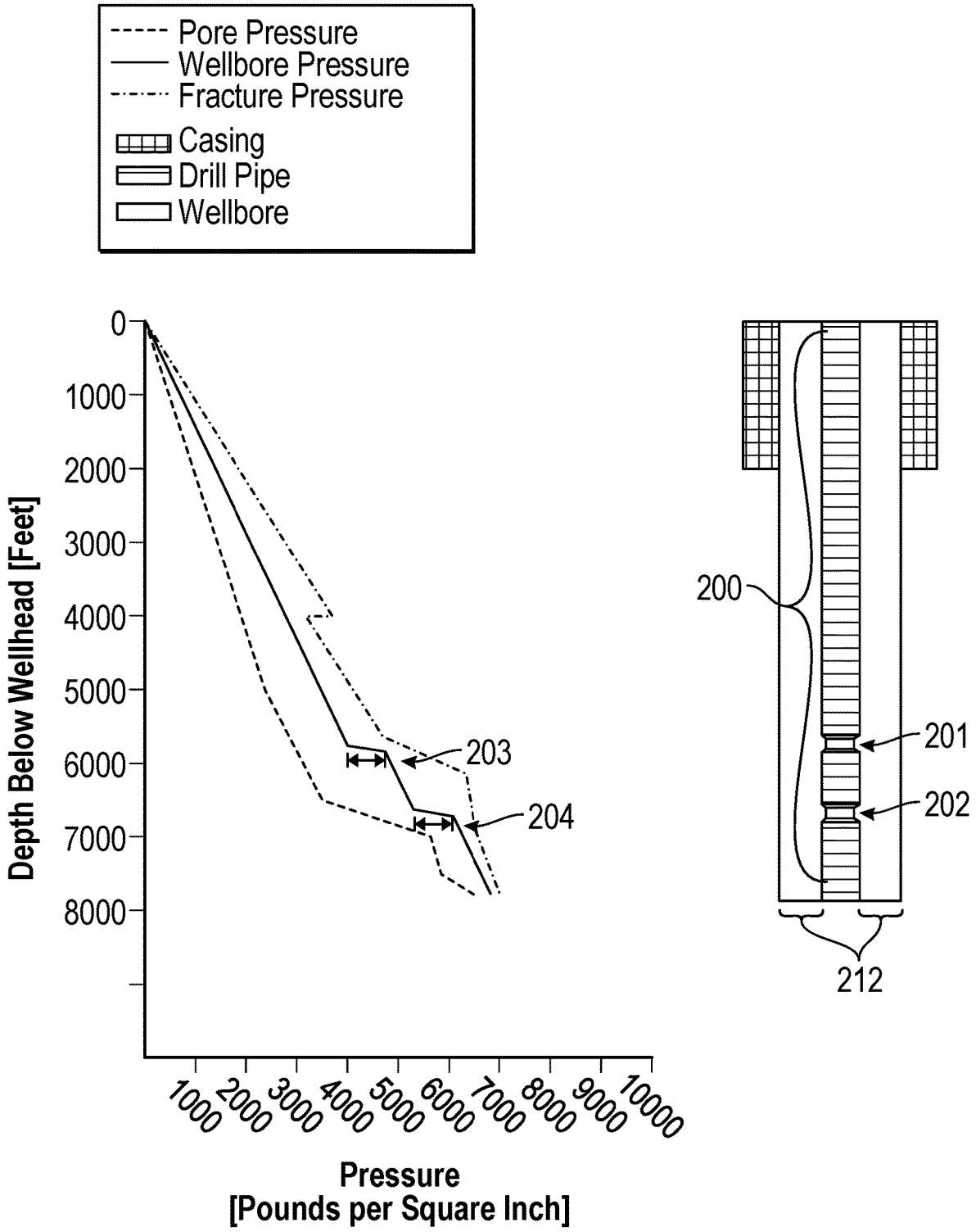
FIG. 2 illustrates the concept of magnetic gradient drilling according to various example embodiments described herein.

FIG. 2 illustrates the concept of magnetic gradient drilling. As shown in FIG. 2, the drill string 200 includes a first magnetic assembly tool 201 and a second magnetic assembly tool 202. Each of the magnetic assembly tools 201 and 202 along the drill string 200 imposes an additional pressure drop 203 and 204, respectively, between the upstream and downstream of the flow in the annulus 212 between the wellbore and the drill pipe. By way of convention, because fluid moves up in the annulus 212 (as opposed to down within the drill pipe of the drill string 200), upstream flows in the annulus 212 are categorized as having a greater depth than fluid moving down the drill string 200. The additional pressure drops 203 and 204 along the annulus 212 amount to jumps in equivalent mud density seen by the formation upstream of the flow. In FIG. 2, this is illustrated by the jumps in the wellbore pressure at 203 and 204. Thus, magnetic gradient drilling according to the embodiments described herein can be used to help eliminate the need to set multiple intermediate casing strings. The elimination of even one level of casing can result in cost savings and reduced environmental concerns, among other advantages.

In the remaining figures, the illustrations are 2-D representations of the embodiments. In practice, the components are axisymmetric (substantially axisymmetric) protrusions of the illustrations shown. Further, the figures are representative and not drawn to scale. In practice, the drill strings, casings, magnetic assembly tools, etc., can be larger or smaller, proportionately, as compared to that shown. Additionally, the configurations of the drill strings, casings, and magnetic assembly tools are representative and can be arranged in other ways. The sizes and proportions of the annular regions, wellbores, etc., are also representative and, in some cases, exaggerated to convey the concepts described herein.

Figure 3:
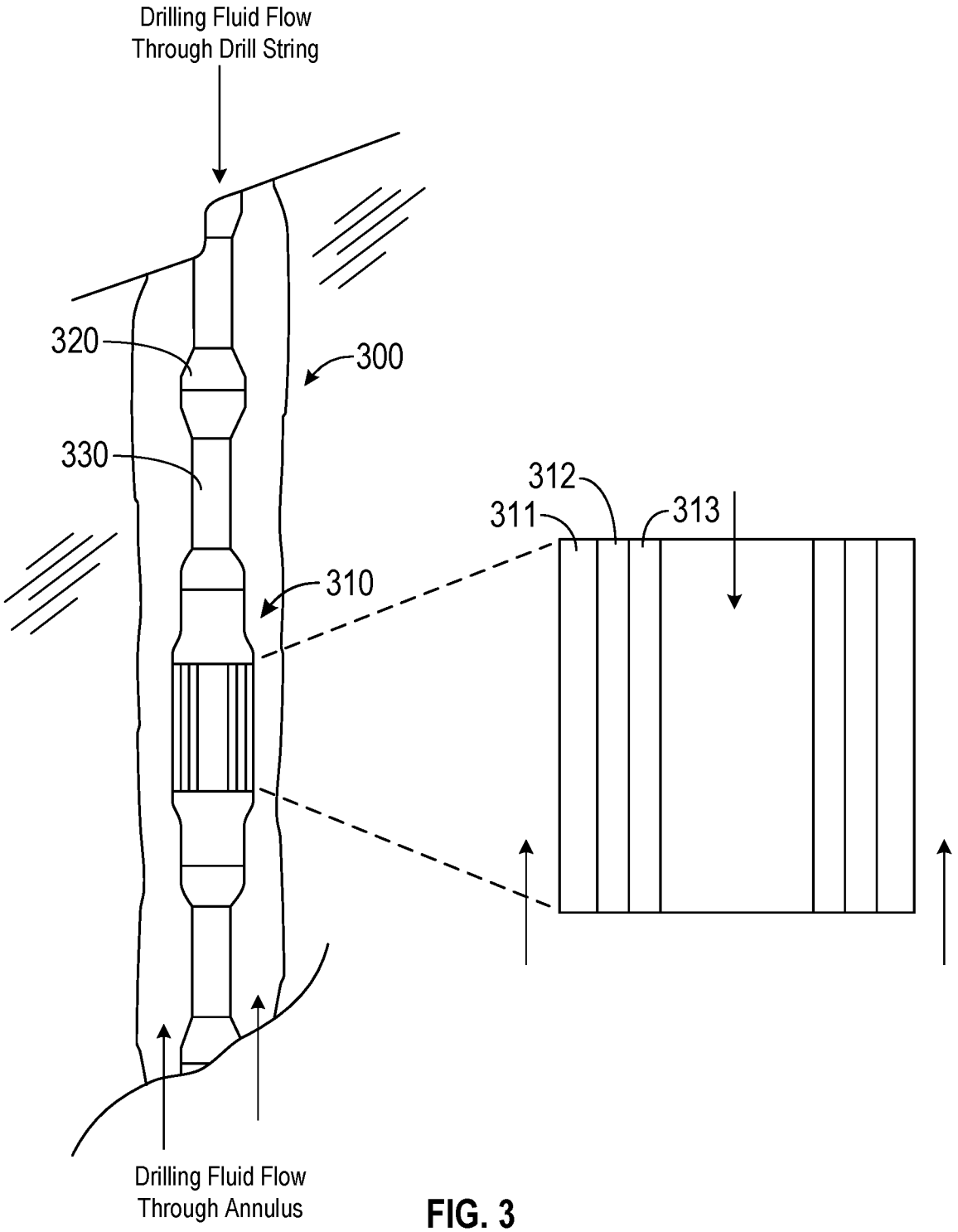
FIG. 3 illustrates an example drill string and magnetic assembly tool in the drill string according to various example embodiments described herein.

To introduce the concepts, FIG. 3 illustrates an example drill string 300 and magnetic assembly tool 310 in the drill string 300. On the right, FIG. 3 shows various layers of the magnetic assembly tool 310. As shown, the magnetic assembly tool 310 includes a protective material 311, a magnetic field generator 312, and an inner layer 313. The protective material 311 prevents (or helps to prevent) the drilling fluid flowing through the annulus from contacting the magnetic field generator 312. The protective material 311, in one embodiment, has relatively minimal magnetic shielding effect.

Among various embodiments, the magnetic field generator 312 can be embodied as any suitable magnetic material and/or mechanism. Among others, the magnetic field generator 312 can be embodied as one or more magnetostrictive materials, permanent magnets, electromagnets, or a combination thereof. The inner layer 313 can be embodied as any suitable material that protects the magnetic field generator 312 from the drilling fluid flowing through the drill string 300 and can have magnetic shielding properties.

On the left, FIG. 3 illustrates how the magnetic assembly tool 310 can be placed between joints 320 of drill pipes 330 in the drill string 300. As is conventional in the industry, a drill string 300 can consist of potentially hundreds or more joints 320 and pipes 330, and FIG. 3 only shows a single installation point of a single magnetic assembly tool 310. The embodiments include the use of any number of magnetic assembly tools similar to the magnetic assembly tool 310 at various installation points along a drill string similar to the drill string 300.

Figure 4:
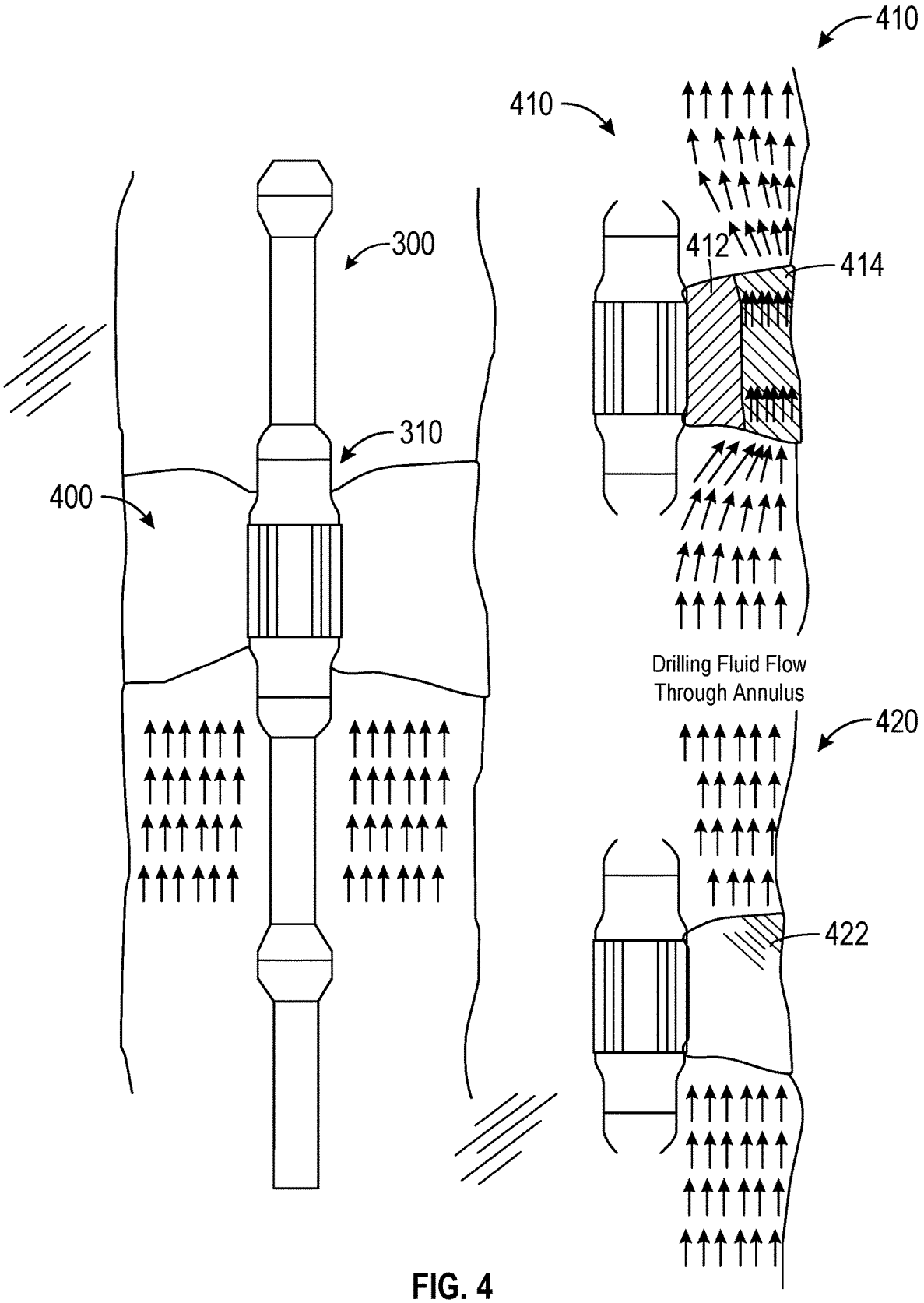
FIG. 4 illustrates representative pressure drop mechanisms and how the magnetic assembly tool shown in FIG. 3 generates a region of magnetic field in an annulus according to various example embodiments described herein.

FIG. 4 illustrates a representative region 400 of magnetic field in the annulus surrounding the drill string 300. The region 400 can be generated by the magnetic assembly tool 310 shown in FIG. 3. Depending on the magnetic field distribution and the reactivity of the magnetorheological drill fluid, two types of effects can cause a pressure drop.

The illustration at 410 in FIG. 4 shows the behaviour in which drill fluid is gelled up, coagulated, and/or constricted in the region 412 within the presence of a magnetic field generated by the magnetic assembly tool 310. The region 412 is adjacent to the magnetic assembly tool 310, and the drill fluid can be gelled up against the magnetic assembly tool 310 in the region 412. In that state, only a limited region 414 of the flow path through the annulus is open for fluid movement. This is a "choke like" behaviour. Chokes are frequently used in hydraulic applications to produce a similar effect and they create a pressure drop across them.

The illustration at 420 in FIG. 4 shows the behaviour in which the drill fluid still moves through the region 422, but the rheological properties of the drill fluid (e.g., the viscosity of the drill fluid) have increased. This also causes a pressure drop. Based on the state of the system, the effect can be a combination of both behaviours, such as a gelled region near the magnetic assembly tool and a region of higher viscosity at further radial distances.

Figure 5A:
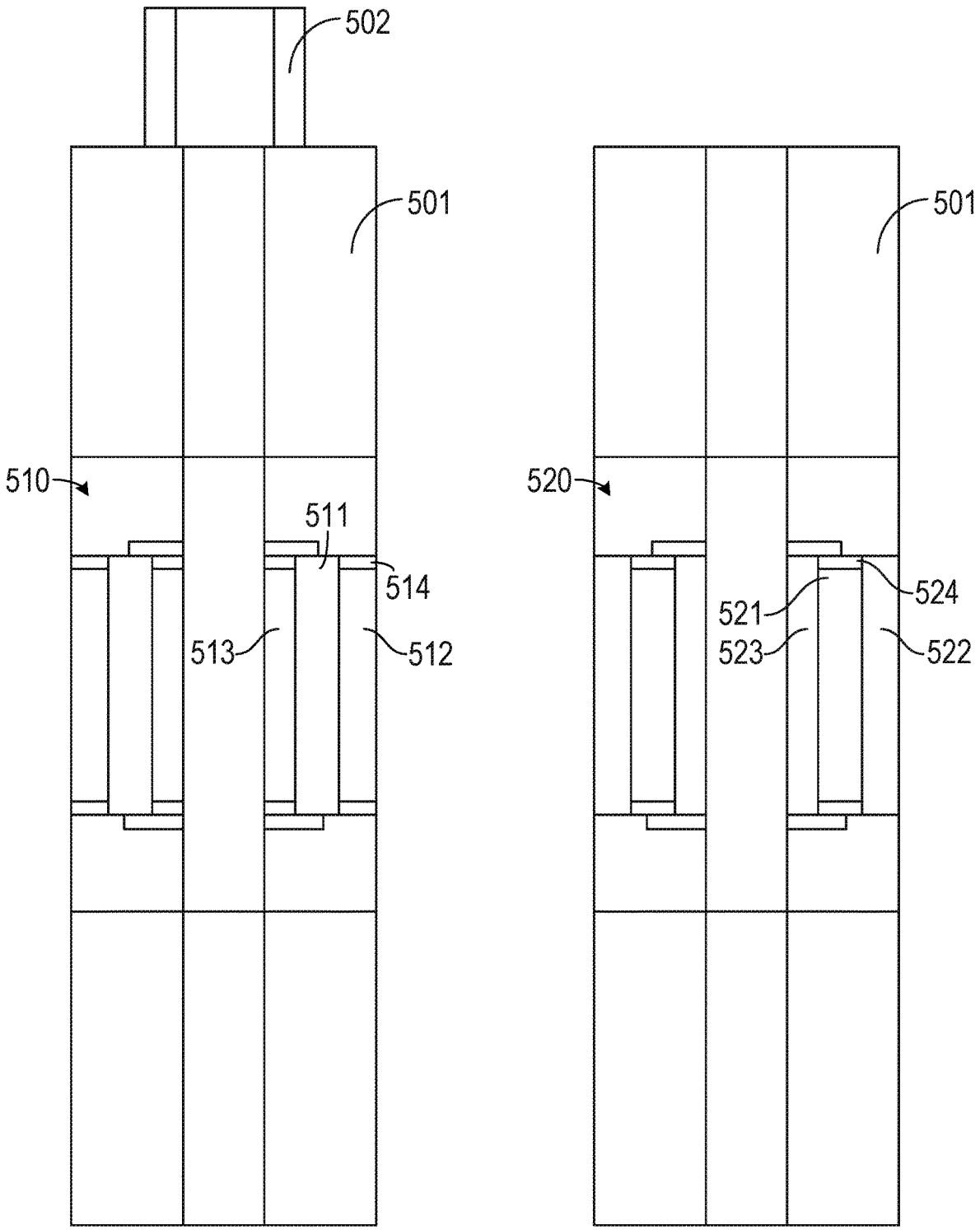
FIGS. 5A and 5B illustrate examples of a drill string including magnetic assembly tools that can be used in the drill string according to various example embodiments described herein.
Figure 5B:
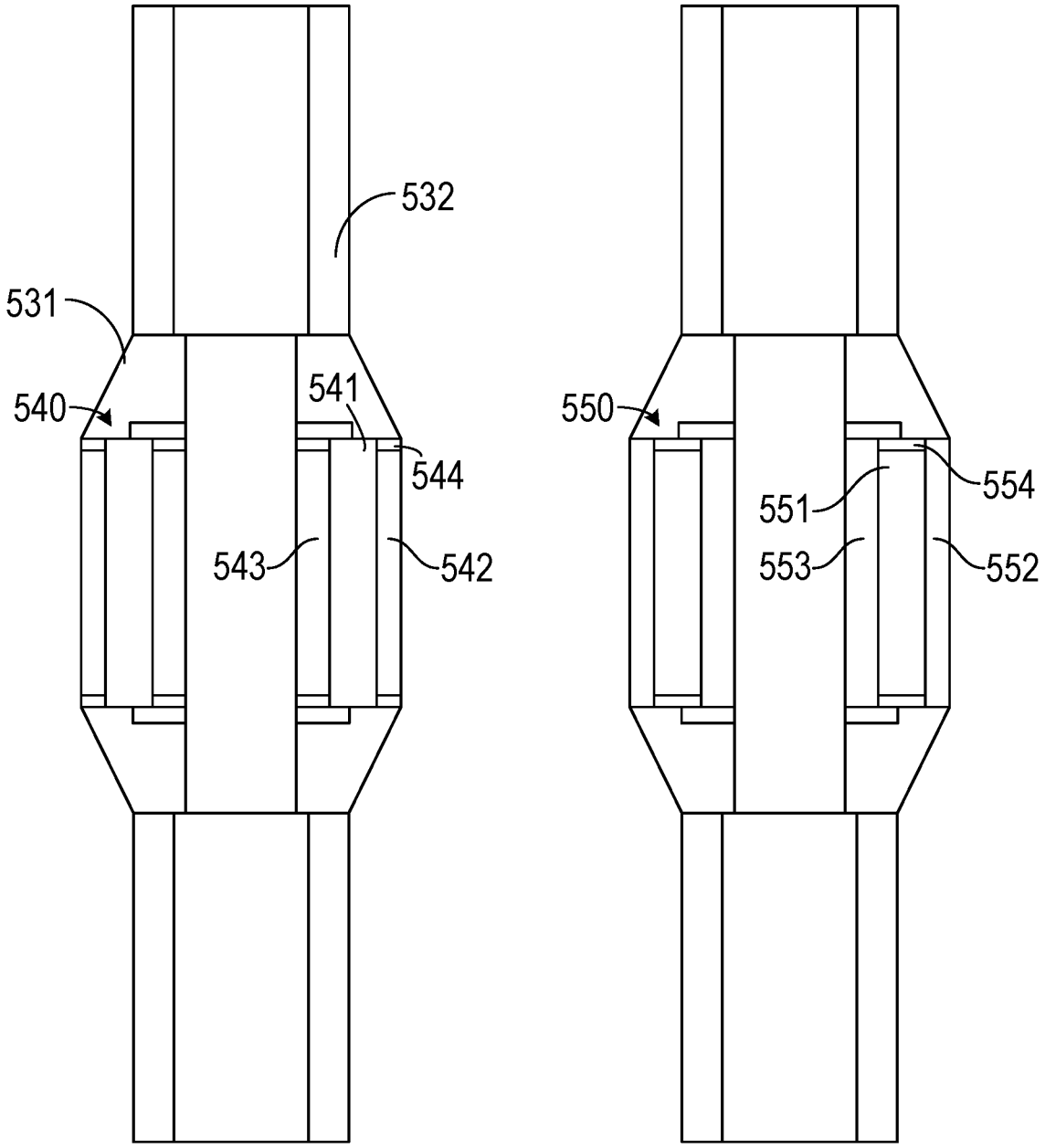

FIGS. 5A and 5B illustrate examples of a drill string including magnetic assembly tools that can be used in connection with or as a substitute for one or more components, such as the drill collar, tool joints, and other components, in the drill string. On the left in FIG. 5A, a drill collar 501 is connected at the bottom of a drill pipe 502, and the drill collar 501 includes a magnetic assembly tool 510. Although not shown, a drill bit can be connected to the bottom of the drill collar 501. There is typically a certain amount of compression prescribed on a drill bit. The pressure can be dictated, in part, by drilling parameters determined by a drilling engineer. The tension-compression axial force along the drill string is a function of the weight of the drill string and other factors. Drill collars are relatively heavier than drill pipes per unit length because they have a smaller inner diameter (ID) and larger outer diameter (OD).

In the magnetic assembly tool 510, one or more magnetostrictive materials 511 react to deformation (e.g., based on the forces of tension and/or compression in various directions) caused by the state of axial tension/compression, for example, in the drill string. In other words, when deformed or in the presence of forces causing deformation, the magnetostrictive materials 511 generate a magnetic field. Thus, as the drill string is rotated, compressed, etc., the magnetostrictive materials 511 can generate a magnetic field.

In one embodiment, the axial forces through the drill string are substantially transferred through a middle layer of magnetostrictive materials 511 in the magnetic assembly tool 510, while the outer and inner layers 512 and 513 carry or transfer relatively less axial force. This can be achieved by placing sealing mechanisms 514 at one or more locations above and/or below the outer and inner layers 512 and 513 as shown in FIG. 5A. The sealing mechanisms 514 are less rigid than the outer and inner layers 512 and 513 and, as such, do not transfer as much axial force. The sealing mechanisms 514 can be formed from any material of suitable compliance and/or elasticity to absorb axial forces. Based on the level of the compliance and/or elasticity of the sealing mechanisms 514, the amount of axial force or load (if any) carried by the outer and inner layers 512 and 513 can be adjusted.

In the magnetic assembly tool 520 shown on the right in FIG. 5A, one or more permanent magnets 521 are used rather than magnetostrictive materials. In this case, most of the axial load can be carried by the outer and inner layers 522 and 523, and sealing mechanisms 524 are located above and/or below the permanent magnets 521. Both cases shown in FIG. 5A show how magnetic assembly tools can be placed, integrated, or incorporated in a drill collar.

FIG. 5B illustrates how magnetic assembly tools can be placed, integrated, or incorporated in drill pipes or joints between drill pipes. On the left in FIG. 5B, a drill joint 531 joins sections of drill pipe 532, and the drill joint 531 includes a magnetic assembly tool 540. Similar to that described above with reference to FIG. 5A, the magnetic assembly tool 540 includes one or more magnetostrictive materials 541 that react to deformation (e.g., based on the forces of tension and/or compression in various directions) in the drill string. Thus, as the drill string is rotated, compressed, etc., the magnetostrictive materials 541 can generate a magnetic field.

The axial forces can be substantially transferred through the middle layer of magnetostrictive materials 541, while the outer and inner layers 542 and 543 carry or transfer relatively less axial force. Again, this can be achieved by placing sealing mechanisms 544 at one or more locations above and/or below the outer and inner layers 542 and 543 as shown in FIG. 5B. The sealing mechanisms 544 are less rigid than the outer and inner layers 542 and 543 and, as such, do not transfer as much axial force. The sealing mechanisms 544 can be formed from any material of suitable compliance and/or elasticity to absorb axial forces.

Based on the level of the compliance and/or elasticity of the sealing mechanisms 544, the amount of axial force or load (if any) carried by the outer and inner layers 542 and 543 can be adjusted.

In the magnetic assembly tool 550 shown in FIG. 5B, one or more permanent magnets 551 are used rather than magnetostrictive materials. In this case, most of the axial load can be carried by the outer and inner layers 552 and 553, and sealing mechanisms 554 are located above and/or below the permanent magnets 551. Both cases shown in FIG. 5B show how magnetic assembly tools can be placed, integrated, or incorporated in joints between drill pipes. In other cases, the magnetic assembly tools can be placed or integrated along the length of a drill pipe itself. In other words, magnetic assembly tools are not limited to placement in joints between sections of drill pipes in a drill string.

Figure 6:
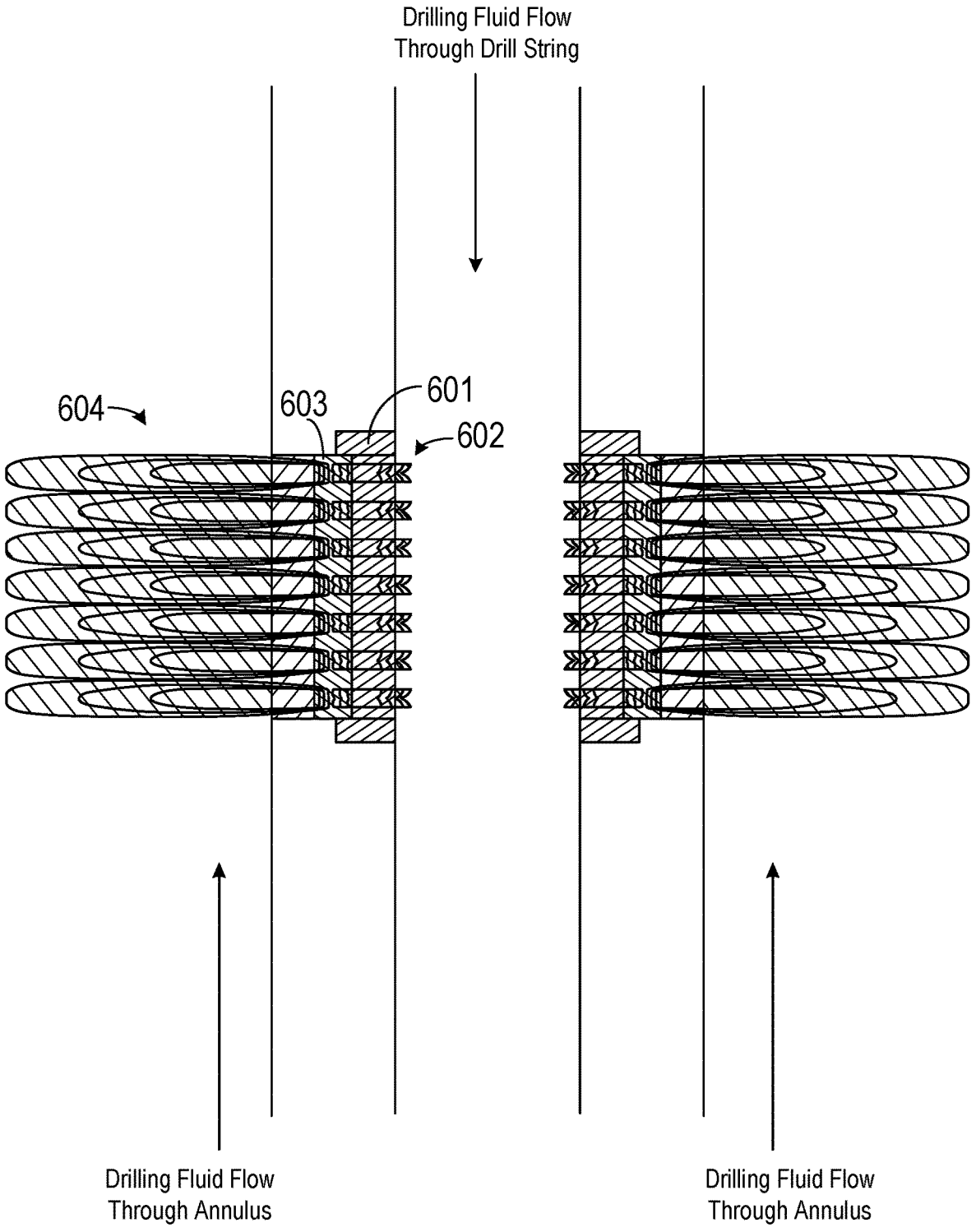
FIG. 6 illustrates an example magnetic shielding mechanism according to the embodiments in which magnetic flux is permitted outside a drill pipe and reduced inside the drill pipe.

FIG. 6 illustrates an example magnetic shielding mechanism according to the embodiments in which magnetic flux is permitted outside a drill pipe and reduced inside the drill pipe. The proposed system relies upon non-constricted flow of drilling fluid through drill pipes and constricted flow in the annulus. FIG. 6 shows the manner in which this is accomplished by a magnetic assembly tool described herein based on magnetic shielding of magnetorheological drilling fluid inside a drill pipe (but not outside the drill pipe).

As shown in FIG. 6, the magnetic shield 601 attracts a significant amount of the strength of the magnetic field 602 directed by the magnet 603 toward the inside of the drill pipe, leaving the drilling fluid within the drill pipe almost unaffected. On the other hand, the magnetic field 604 is directed by the magnet 603 toward the outside of the drill pipe, into the annular region, affecting drilling fluid in that region. No magnetic shield is used to divert or capture the magnetic field 604 in the manner that the magnetic field 602 is captured. The magnetic shield 601 can be embodied as a conductor of magnetic fields, such as iron, steel, etc. FIG. 6 shows that the magnetic shield 601 covers the inside surface of the magnet and also nearly half of its upper and lower boundaries. In other cases, the magnetic shield 601 may cover more or less of the upper and lower boundaries of the magnet in addition to its inside surface.

Figure 7:
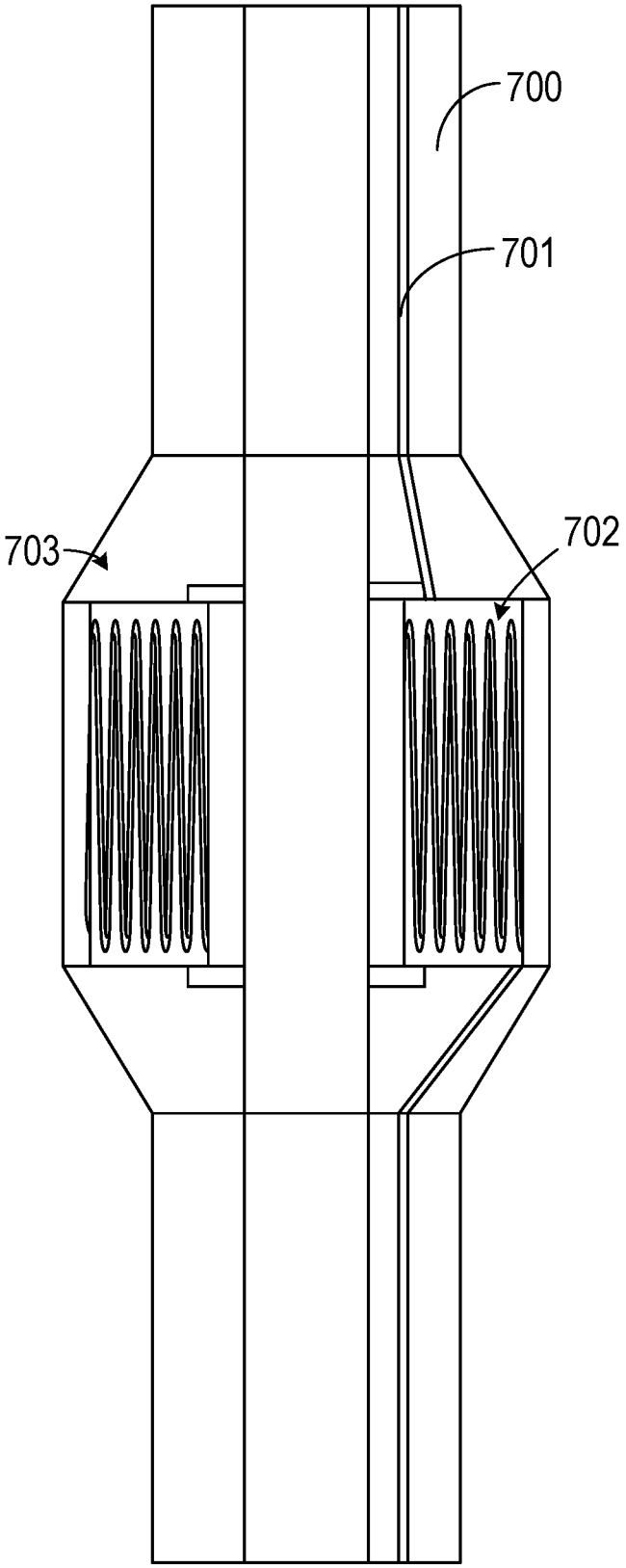
FIG. 7 illustrates an example magnetic assembly tool using an electromagnet fed by a wired drill pipe according to various example embodiments described herein.

FIG. 7 illustrates a drill pipe 700 including one or more wires 701 that can be used to provide power to an electromagnet 702 in a magnetic assembly tool 703. National Oilwell Varco®, for example, has developed a pipe system called Intelliserv™. The system relies upon a modification of traditional drill string with a string of co-axial wire run down the drill pipe. In this embodiment, the electromagnet 702 or solenoid is used in place of (or in addition to) a magnetostrictive material and/or a permanent magnet as shown in FIGS. 5A and 5B. Power for the electromagnet 702 can be provided through the wires 701 that runs through the drill pipe 700.

Again, the embodiments described herein achieve selective pressure drop points along the annulus fluid path for drilling operations. The embodiments allow for selective drilling mud rheology alteration points along the fluid path through the annulus. Because the system achieves selective manipulation of the annulus pressure profile to follow or track pressure requirements for various subterranean formations, it can help to reduce the need to set strings of intermediate casings, among other advantages.

Other applications of the embodiments include, but are not limited to, the activation of one or more magnetic assembly tools (installed at a depth sufficiently higher than the bit) in the event of a kick. A kick can be any unwanted flow of formation fluids into the wellbore, for example, due to insufficient wellbore pressure in comparison to that particular high (usually abnormal) pressured subterranean formation. A kick, if not handled properly, can result in an uncontrolled flow of formation fluids to the surface, also known as a blow out in some industry definitions.

Current industry well control practices involve circulating the kick by applying back pressure using a choke at the surface. The flow exiting the annulus is choked and the kick is circulated out while inhibiting the troublesome formation from extra kicks. This industry practice applies a back pressure that is felt by the entire open hole interval. This amounts to a shift to the right in drilling fluid equivalent mud weight (e.g., as shown in FIG. 1 by a steeper pressure gradient). Although this practice can inhibit the high pressure formation from sending additional influx, the back pressure felt by shallower formations can result in a fracture. A fracture will, in many cases, result in the wellbore fluid uncontrollably entering that particular subterranean formation through the fracture. This situation is typically called an underground blowout. An underground blowout, if not handled properly, can also escalate to a surface blow out. The embodiments can mitigate this situation by imposing back pressure at selected downhole point(s) (other than at the surface). If placed properly, extra back pressure can be applied only to stronger (e.g., deeper) downhole formations and not weaker formations.

Additionally, although a number of embodiments are described in connection with drill strings, drill pipes, drill collars, etc., magnetic assembly tools can be incorporated into other downhole components. For example, one or more magnetic assembly tools can be incorporated into casings. In that case, the embodiments allow for selective cement rheology alteration points along the fluid path through the annulus for cementing operations.

Although embodiments have been described herein in detail, the descriptions are by way of example. The features of the embodiments described herein are representative and, in alternative embodiments, certain features and elements may be added or omitted. Additionally, modifications to aspects of the embodiments described herein may be made by those skilled in the art without departing from the spirit and scope of the present invention defined in the following claims, the scope of which are to be accorded the broadest interpretation so as to encompass modifications and equivalent structures.

The invention claimed is:

1. A system, comprising:

a drill pipe; and a magnetic assembly tool connected to or integrated with the drill pipe, the magnetic assembly tool comprising:

a downhole magnetic field generator configured to generate a magnetic field and create an upstream pressure drop in magnetorheological fluid outside the drill pipe, wherein the magnetic field creates a limited region in a wellbore for an upstream flow of the magnetorheological fluid outside the drill pipe; and a magnetic shielding material configured to shield the magnetic field from the magnetorheological fluid inside the drill pipe.

2. The system of claim 1, wherein the magnetorheological fluid flows downstream inside the drill pipe and flows upstream outside the drill pipe.

3. The system of claim 1, wherein the downhole magnetic field generator is configured to selectively generate the magnetic field based on an electric current or axial force applied to the drill pipe.

4. The system of claim 1, wherein the downhole magnetic field generator comprises at least one of a magnetostrictive material, a permanent magnet, or an electromagnet.

5. The system of claim 1, wherein the downhole magnetic field generator comprises a magnetostrictive material, and the magnetic assembly tool further comprises a sealing mechanism configured to direct axial force applied to the drill pipe into the magnetostrictive material to generate or modify the magnetic field.

6. The system of claim 1, wherein the magnetorheological fluid coagulates in the magnetic field outside the drill pipe to create a choke point in an annulus outside the drill pipe.

7. The system of claim 6, wherein the magnetic shielding material is configured to shield the magnetic field from a downstream flow of the magnetorheological fluid inside the drill pipe.

8. An assembly, comprising:

a downhole magnetic field generator configured to generate a magnetic field and create a pressure drop in an upstream flow of magnetorheological fluid, wherein the magnetic field creates a limited region in a wellbore for the upstream flow of the magnetorheological fluid outside the drill pipe; and a magnetic shielding material configured to shield the magnetic field from a downstream flow of the magnetorheological fluid.

9. The assembly of claim 8, wherein the magnetorheological fluid flows downstream inside a drill pipe or a casing and flows upstream outside the drill pipe or casing.

10. The assembly of claim 8, wherein the magnetorheological fluid comprises a magnetorheological drill fluid or a magnetorheological cement.

11. The assembly of claim 8, wherein the magnetic field generator comprises at least one of a magnetostrictive material, a permanent magnet, or an electromagnet.

12. The assembly of claim 8, wherein the magnetic field generator comprises a magnetostrictive material, and the assembly further comprises a sealing mechanism configured to direct force into the magnetostrictive material to generate or modify the magnetic field.

13. The assembly of claim 8, wherein the magnetorheological fluid coagulates in the magnetic field outside a drill pipe or a casing to create a choke point in an annulus outside the drill pipe or the casing.

14. The assembly of claim 13, wherein the magnetic shielding material is configured to shield the magnetic field from the magnetorheological fluid inside the drill pipe or the casing.

15. A system, comprising:

a magnetic assembly tool connected to or integrated with a drill pipe or casing, the magnetic assembly tool comprising:

a magnetic field generator configured to generate a magnetic field and create an upstream pressure drop in magnetorheological fluid outside the drill pipe or casing, wherein the magnetic field creates a limited region for an upstream flow of the magnetorheological fluid outside the drill pipe; and a magnetic shielding material configured to shield the magnetic field from the magnetorheological fluid inside the drill pipe or casing.

16. The system of claim 15, wherein the magnetic field generator is configured to selectively generate the magnetic field based on an electric current.

17. The system of claim 15, wherein the magnetic field generator is configured to selectively generate the magnetic field based on an axial force applied to the drill pipe.

18. The system of claim 15, wherein the magnetic field generator comprises at least one of a magnetostrictive material, a permanent magnet, or an electromagnet.

19. The system of claim 15, wherein the magnetic field generator comprises a magnetostrictive material, and the magnetic assembly tool further comprises a sealing mechanism configured to direct axial force applied to the drill pipe or the casing into the magnetostrictive material to generate or modify the magnetic field.

20. The system of claim 15, wherein the magnetorheological fluid coagulates in the magnetic field outside the drill pipe or the casing to create a choke point in an annulus outside the drill pipe or the casing.

* * * * *